United States Patent [19]

Hofmann

[11] 4,097,937

[45] Jul. 4, 1978

[54] APPARATUS FOR CLEARING DRAINS

[76] Inventor: Hermann L. Hofmann, 4847 Kent Ave, Niagara Falls, Ontario, Canada, L2H 1J5

[21] Appl. No.: 792,531

[22] Filed: May 2, 1977

[51] Int. Cl.[2] ..... E03D 11/00

[52] U.S. Cl. ..... 4/255

[58] Field of Search ..... 4/255, 256, 257

[56] References Cited

U.S. PATENT DOCUMENTS

| | | | |
|---|---|---|---|
| 2,218,050 | 10/1940 | Price | 4/257 |
| 2,267,064 | 12/1941 | Wikelund | 4/255 |
| 2,274,304 | 2/1942 | Perry | 4/255 X |
| 2,300,319 | 10/1942 | Smith | 4/255 |
| 2,456,092 | 12/1948 | Storevik | 4/255 |
| 2,626,404 | 1/1953 | Marks | 4/255 |
| 2,672,160 | 3/1954 | Wrabel | 138/89.2 |

*Primary Examiner*—Henry K. Artis

[57] ABSTRACT

A device for clearing drains has an air reservoir which may be filled from an external source of compressed air, a rubber cup connected by a neck into the base of the reservoir, and a valve stem passing through the neck and connecting a valve member within the reservoir and normally seated on and closing the neck with an actuator member within the cup.

5 Claims, 1 Drawing Figure

APPARATUS FOR CLEARING DRAINS

FIELD OF THE INVENTION

This invention relates to a device for clearing the drains of sinks, baths and the like.

REVIEW OF THE PRIOR ART

Numerous devices have been proposed for clearing blocked drains, one common type having a flexible sealing member for engaging the drain opening in a sink or the like, and means for delivering a charge of pressurized gas to the opening. In its simplest form, a rubber cup serves both to establish the seal and to pressurize the air, but in more sophisticated devices a reservoir of compressed gas has been provided, together with a valve by means of which the gas may be discharged through the flexible sealing member into the drain. The reservoir may be equipped with a hand pump to build up the desired pressure, or cartridges of precompressed gas may be employed.

Devices of the above mentioned types have been the subject of numerous patents, of which however special mention may be made of U.S. Pat. No. 2,300,319, issued Oct. 27, 1942 to R. L. Smith. In this patent, a cylindrical gas reservoir is provided, with a sliding hollow stem entering one end of the reservoir and supporting at its inner end a valve and at its outer end a flexible sealing member for engagement with a drain opening. The stem is spring-biased outwardly so as to maintain the valve in a closed condition, but when the flexible sealing member is pressed against a drain opening, the stem is moved inwardly and the valve is opened, permitting compressed gas stored in the reservoir to flow through the hollow stem and the flexible sealing member into the drain opening. Although the possibility of using an external source of compressed air for filling the reservoir is disclosed, it is preferred to use a small capsule of highly compressed carbon dioxide to charge the cylinder.

The arrangement disclosed in U.S. Pat. No. 2,300,319 has some disadvantages. Firstly, if carbon dioxide capsules are used, the apparatus is not wholly reusable, since a new capsule is required each time the apparatus is charged. Since it is no longer considered economical to refill the type of capsules proposed to be used in the patent, operation of the invention would nowadays be somewhat wasteful of resources. Secondly, the sealing member is mounted on a hollow projecting stem. This has to be guided in a quite long and comparatively large diameter sleeve in order to provide a structure sufficiently robust to stand up to the comparatively rough handling such apparatus is likely to suffer when in use. However, the necessarily large bearing area that results from this construction gives rise to the risk of jamming or stiffness due to dirt or corrosion, and the structure is still less robust than would be desirable.

Thirdly, it may sometimes be desired to release the gas from the reservoir comparatively slowly, and this may be difficult with the arrangement shown in U.S. Pat. No. 2,300,319. If an attempt is made to release the air slowly, pressure may build up within the sealing member 46, tending to cause its crown to move upwardly and hence to open the valve further, thus increasing the rate of gas release and still further increasing the pressure within the member 46. Thus once the valve has commenced to open, there may be a positive feedback effect tending to force the valve further open.

This is of course a potential advantage when it is desired to release the gas as rapidly as possible, but in fact there is generally no difficulty in obtaining sufficiently rapid release, and capability of releasing the gas slowly as well as rapidly would be a distinct advantage.

The object of the invention is to provide drain clearing apparatus which, whilst particularly simple in construction, overcomes the above problems.

BRIEF DESCRIPTION OF THE INVENTION

According to the invention, apparatus for clearing drains comprises a reservoir for pressurized gas incorporating a non-return air inlet valve and a pressure relief valve, an inverted infundibular sealing member of elastomeric material having a neck anchored in an orifice in the base of the reservoir, a valve stem passing through an orifice in the neck of said flexible sealing member, a valve member supported within the reservoir by the valve stem, and normally seated on a seat at the inner end of the neck of the sealing member so as to close the neck orifice, and an actuator member adapted to engage the rim of a drain orifice, said actuator member being attached to the outer end of the valve stem and housed within the sealing member. Preferably, the inner end of the valve stem is guided for axial movement by a guide member housed within the reservoir.

The above arrangement requires no disposable gas capsules, since it can be recharged from any convenient source of compressed air or gas, and the valve structure can not only be made exceptionally simple and robust, but also the feedback which occurs when initial opening of the valve causes pressure to build up within the flexible sealing member is of the negative variety, and thus provides some opposition to further opening of the valve. It is thus readily possible if desired to cause the valve to open only slightly although rapid opening is equally easy to achieve.

Further features of the invention will become apparent from the following description.

SHORT DESCRIPTION OF THE DRAWINGS

A preferred embodiment of the invention is shown in section in the single FIGURE of the accompanying drawing.

DESCRIPTION OF THE PREFERRED EMBODIMENT

Figure 1:
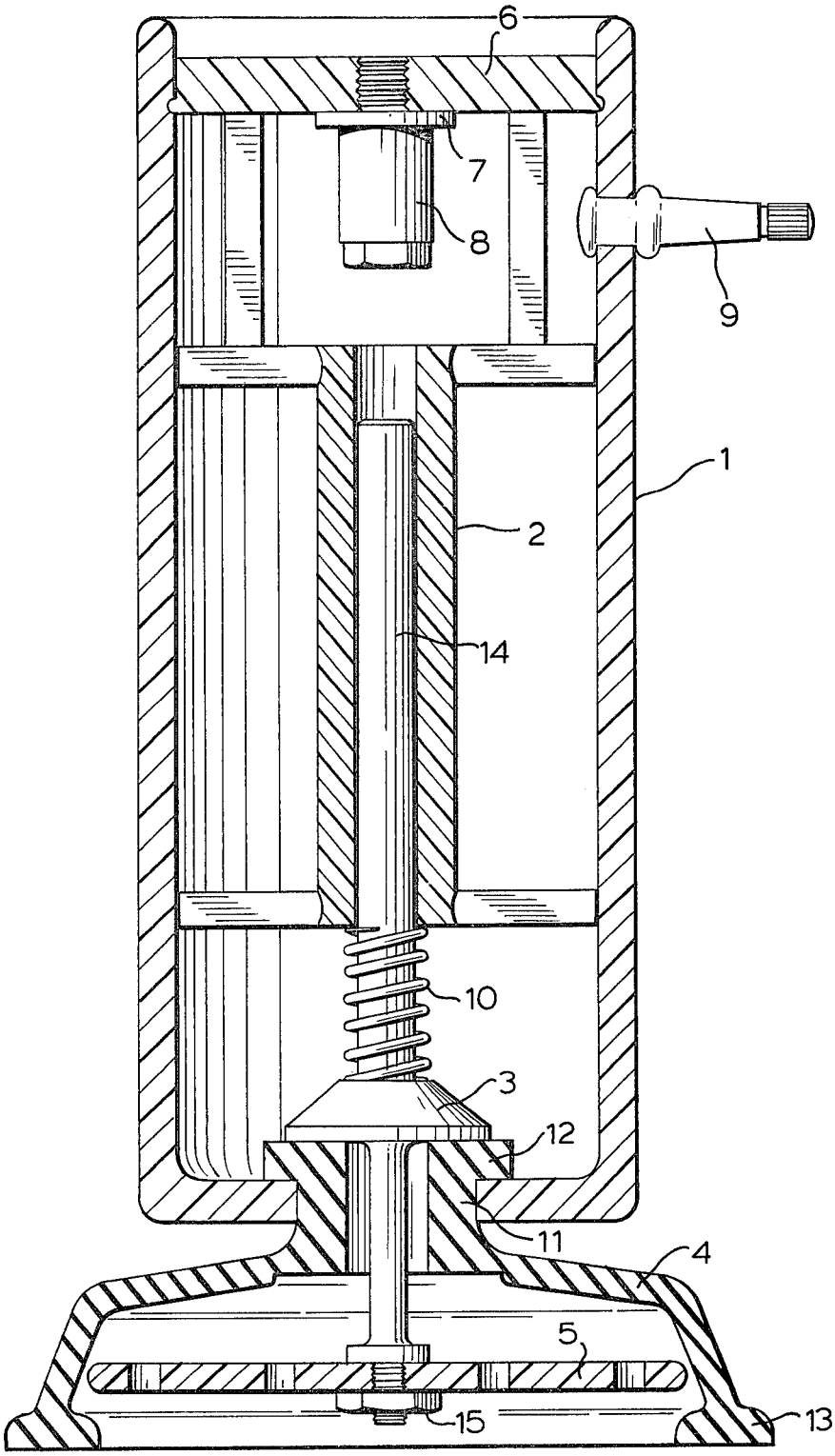

The drain cleaning apparatus comprises an air reservoir 1 of generally cylindrical form, with an integral bottom end and a top end closed by a separately formed top plate 6. Both the cylinder and the top plate may be molded from high tensile synthetic plastics material. The bottom end of the reservoir body has an opening within which is received the neck 11 of an inverted infundibular flexible seal member molded from rubber or other elastomeric material. The neck 11 of the sealing member 4 is retained in the opening in the body 1 by a peripheral flange 12 which also serves a further function described further below. A flange 13 at the lower end of the sealing member is configured so as to be able to enter sealing relationships with those portions of sinks, baths and the like surrounding their drain outlets.

Located within the body 1 is a cage 2 which may be integral or secured to the top plate 6 and forms a guide for a valve stem 14, the lower end of which extends with clearance through the hollow neck of the sealing member 4, since it is of smaller cross-section than the orifice which is formed within and passes through the neck. The lower extremity of the shaft is secured by a nut 15 to an actuator member 5 in the form of a perforated plate. The function of the plate is to enter engagement with the rim of a drain orifice without unduly restricting the flow of air into the orifice, and it may be of any structure suitable for this purpose.

The valve stem 14 carries a valve member 3 which is normally urged into engagement with a valve seat formed on the inner surface of the flange 12, by means of air pressure within the reservoir and a spring 10 acting between the valve 3 and the cage 2.

The body 2 is equipped with an air inlet valve 9, which is of conventional construction as used on motor vehicle wheels and has the usual non-return characteristic. Screwed into an orifice in the top plate 6 is a pressure relief valve 8 sealed by a washer 7; this valve prevents the buildup of too high a pressure within the body.

In use, the reservoir is filled with compressed air by means of the valve 9 until the release of air through the valve 8 indicates that full working pressure has been achieved. The apparatus is then applied to a drain to be cleared by engaging the lower flange 13 of the sealing member with the surround of the drain opening and pressing the body downwardly so as to deform the sealing member. This provides an improved seal and at the same time enables the plate 5 to engage the rim of the drain opening. The resultant movement of the plate in an upward direction relative to the body 1 results in the valve 3 being lifted from its seating, whereupon air passes from the reservoir, through the neck 11 and into the interior of the sealing member 4. It then passes through the orifices in the plate 5 and is applied to the drain to be cleared. Any buildup of pressure within the sealing member 4 provides a force tending to lift the body and thus close the valve 3, thus assisting in obtaining a readily controllable release of the air from the cylinder. On the other hand, rapid release of the air can be achieved if desired, merely by pressing the body down sufficiently firmly entirely to overcome the feedback effect just described.

Since the sealing member is anchored directly in the body, and the only external moving part, the plate 15, is protected by the rubber sealing member 4, the device is exceptionally robust. Moreover, very few separate parts are required, and the only sliding surface involved, that between the stem 14 and the cage 2, need not be a tight fit; moreover, since it is sealed within the apparatus, it is not exposed to dirt.

What I claim is:

1. Apparatus for clearing drains comprising a reservoir for pressurized gas incorporating a non-return air inlet valve and a pressure relief valve, an inverted infundibular sealing member of elastomeric material having a neck anchored in a opening in the base of the reservoir, an orifice defined within and passing through the neck, a valve steam passing through and of smaller cross-section than the orifice, a valve member supported by the valve stem within the reservoir, a valve seat surrounding the inner end of the orifice and upon which the valve member is normally seated so as to close the orifice, and an actuator member adapted to engage the rim of a drain opening, said actuator member being attached to the outer end of the valve stem and housed within the sealing member.

2. Apparatus according to claim 1, wherein a guide member is housed within the reservoir and guides the valve stem for longitudinal movement, and a spring acts between the guide member and the valve member to urge the latter into its closed position.

3. Apparatus according to claim 1, wherein a peripheral flange is formed on the neck of the sealing member, the flange retaining the sealing member in the orifice in the base of the reservoir and also forming the valve seat.

4. A device for clearing drains comprising a reservoir for compressed gas, an inverted deformable rubber cup anchored by a hollow neck into the base of the reservoir, a valve member within the reservoir and normally seated upon and closing the neck of the cup, an actuator member within the cup, and a valve stem passing with clearance through the hollow neck and connecting the actuator member and the valve member whereby on vertical compression of the cup the actuator member lifts the valve member from the neck.

5. A device according to claim 4 wherein a guide member is housed within the reservoir, and an upper end of the valve stem extends into a guide passage in the guide member.

* * * * *